US007383808B1

(12) United States Patent
Azevedo et al.

(10) Patent No.: US 7,383,808 B1
(45) Date of Patent: Jun. 10, 2008

(54) ARTICULATED PISTON SKIRT

(75) Inventors: Miguel Azevedo, Ann Arbor, MI (US); Carmo Ribeiro, Ann Arbor, MI (US); Eduardo Matsuo, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/772,869

(22) Filed: Jul. 3, 2007

(51) Int. Cl.
*F02F 3/00* (2006.01)

(52) U.S. Cl. ..... 123/193.6

(58) Field of Classification Search ..... 92/187, 92/208, 216, 255; 123/193.6
See application file for complete search history.

(56) References Cited

U.S. PATENT DOCUMENTS 1,515,802 A * 11/1924 Watson ..... 92/234
1,943,364 A * 1/1934 Betz ..... 92/187
3,403,605 A 10/1968 Schmidt
3,906,924 A 9/1975 Elsbett
7,100,494 B2 * 9/2006 Petersen et al. ..... 92/187
7,290,518 B2 * 11/2007 Ishimitsu et al. ..... 123/197.1
2006/0213479 A1 9/2006 Ishimitsu et al.

FOREIGN PATENT DOCUMENTS

JP 357186045 A * 11/1982 ..... 123/193.6

* cited by examiner

*Primary Examiner*—M. McMahon
(74) *Attorney, Agent, or Firm*—Robert L Stearns; Dickinson Wright PLLC

(57) ABSTRACT

A piston head has a top extending radially about a first axis and first and second pin bosses depending downwardly and defining first and second pin bores. A connecting rod includes a fork having first and second connecting bosses spaced apart from each other and defining first and second connecting bores. A piston skirt extends cylindrically and includes a bridge extending diametrically through the first axis defining a skirt bore for axial alignment with said pin bores and said connecting bores. The bridge is disposed between the first and second connecting bosses, which are disposed between the pin bosses. The pin bores are axially aligned with the connecting bores and with the skirt bore. A wrist pin extends within the pin bores and the connecting bores and the skirt bore along the second axis to interconnect the piston head and the connecting rod and the piston skirt.

16 Claims, 3 Drawing Sheets

ARTICULATED PISTON SKIRT

BACKGROUND OF THE INVENTION

1. Field of the Invention

The subject invention relates generally to a piston assembly.

2. Description of the Prior Art

Known piston assemblies include a piston head for reciprocation within a cylinder along a piston stroke defining an axis. The piston head includes a pair of pin bosses depending downwardly and defining pin bores axially aligned with each other. A connecting rod extends between a piston end and a crank end. The piston end includes a connecting boss defining a connecting bore axially aligned with the first and second pin bores. A wrist pin extends through the connecting bore and the pin bores to interconnect the piston head to the connecting rod in articulated fashion. A cylindrical piston skirt extends along the axis directly below the piston head to guide the piston assembly along the piston stroke. Known piston skirts are fabricated separately from the piston head and are connected to the piston assembly via the wrist pin to form an articulated connection. These articulated piston skirts are typically cast or forged from steel or aluminum.

SUMMARY OF THE INVENTION AND ADVANTAGES

The invention provides for a piston assembly including a piston head having a top extending radially from a first axis. A first pin boss depends from the top and defines a first pin bore. A second pin boss is spaced from the first pin boss and depends from the top and defines a second pin bore axially aligned with the first pin bore. A connecting rod extends between a piston end and a crank end. The piston end of the connecting rod includes a fork having a first connecting boss defining a first connecting bore and having a second connecting boss spaced from the first connecting boss and defining a second connecting bore axially aligned with said first connecting bore. A piston skirt includes a skirt wall extending radially from the first axis for engaging a cylinder wall of an engine cylinder. The piston skirt includes a bridge extending through the first axis, and defining a skirt bore. The bridge is disposed between the first and second connecting bosses. The first and second connecting bosses are disposed between the first and second pin bosses, with the first and second pin bores being axially aligned with the first and second connecting bores and with said skirt bore on a second axis. A wrist pin extends within the first and second pin bores and the first and second connecting bores and the skirt bore along said second axis to interconnect the piston head and the connecting rod and the piston skirt.

The bridge provided with the piston skirt supports the skirt wall against side loads that are generated during the piston stroke. By providing such support, the skirt wall may be formed of a thinner material, such as sheet metal.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
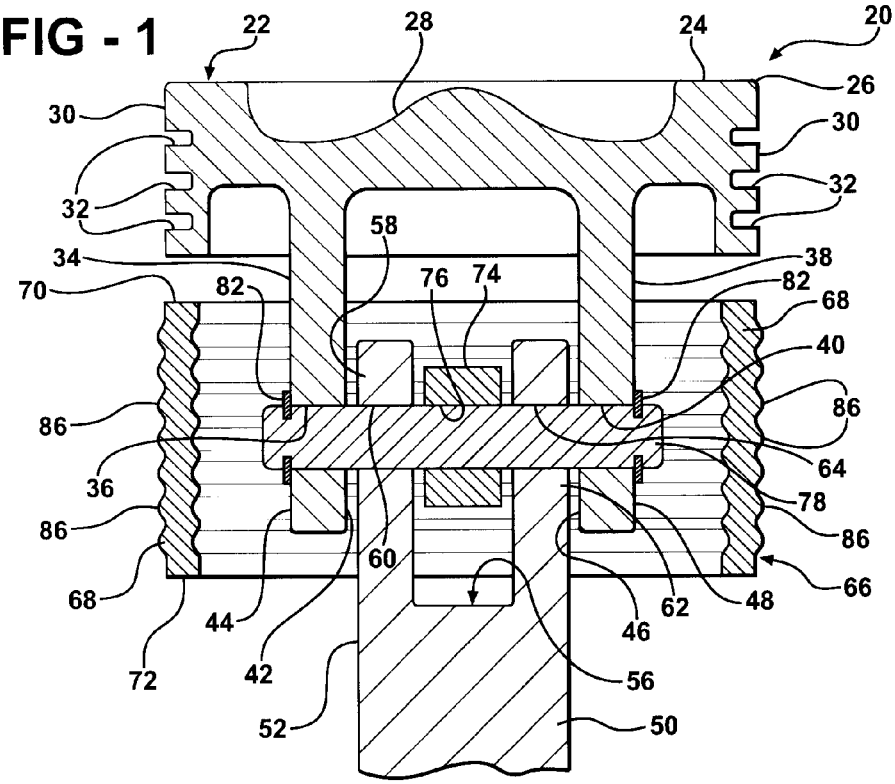
FIG. 1 is a cross sectional view of a piston assembly according to a first exemplary embodiment of the present invention taken along line 1-1 of FIG. 2.
Figure 2:
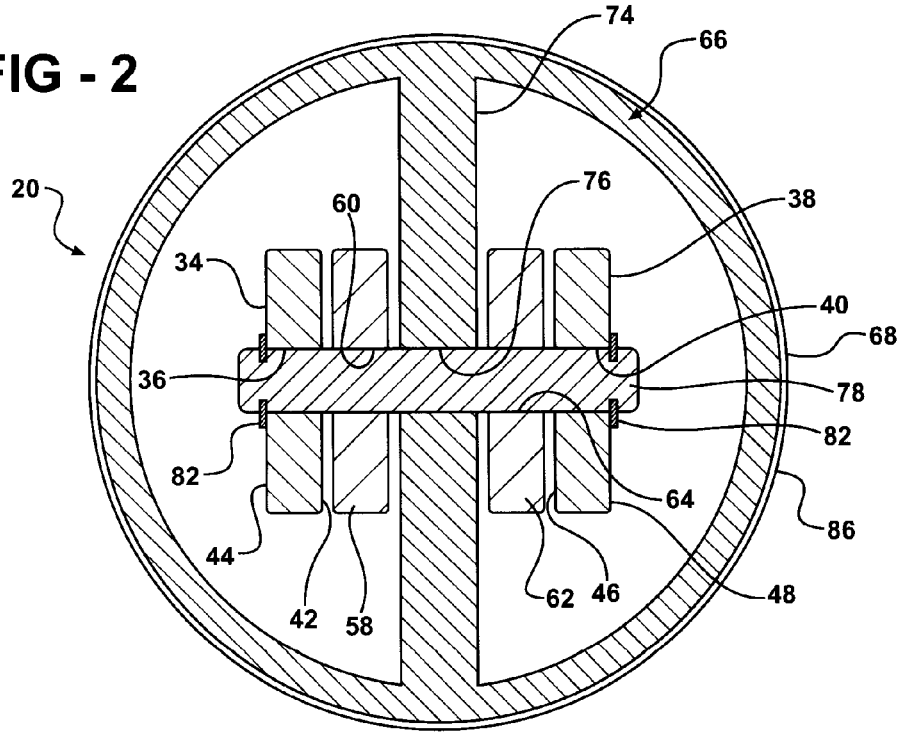
FIG. 2 is a cross sectional view of a piston assembly of the first exemplary embodiment taken along line 2-2 of FIG. 1.
Figure 3:
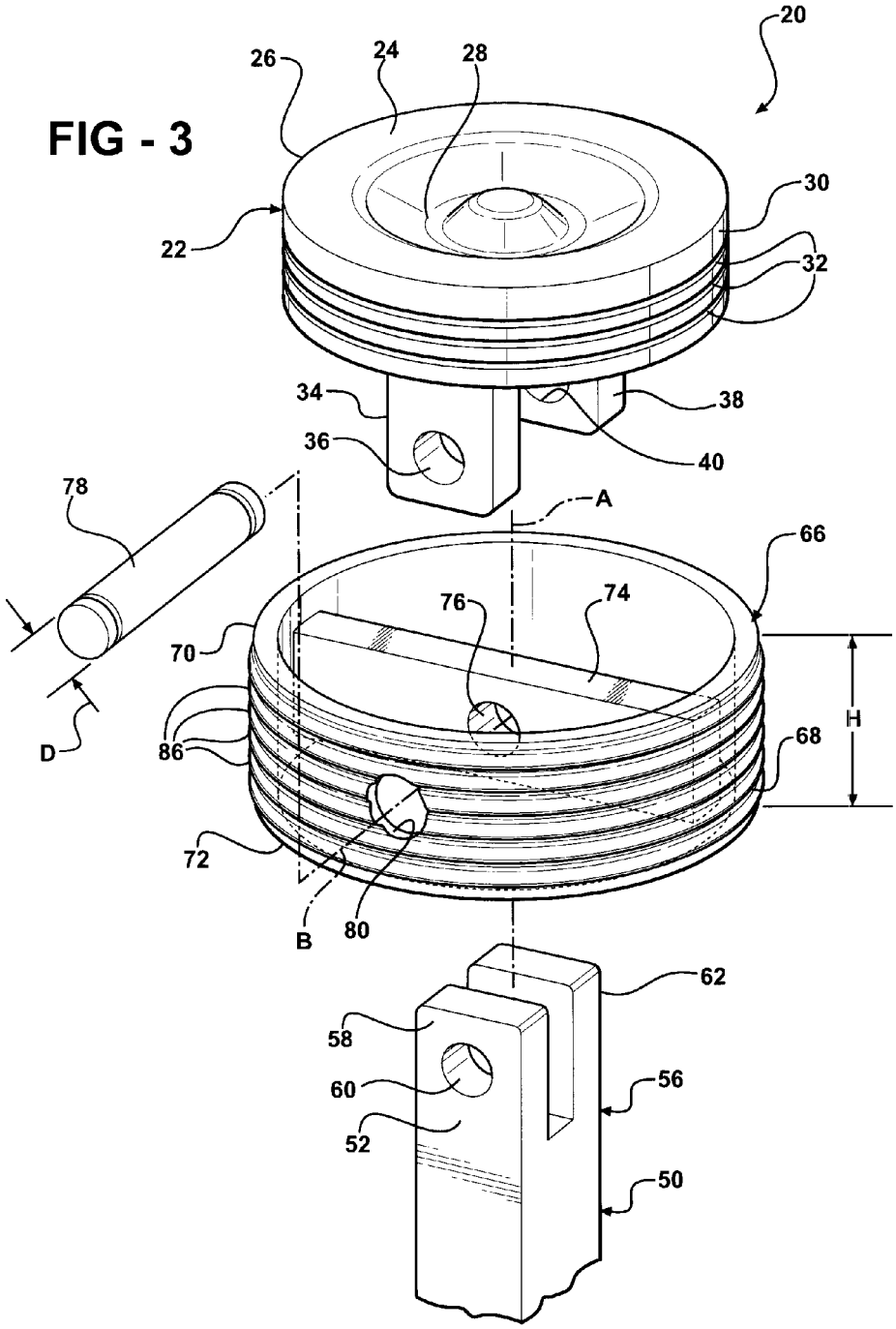
FIG. 3 is an exploded perspective view of a piston assembly of the first exemplary embodiment.

Referring to the Figures, wherein like numerals indicate corresponding parts throughout the several views, a piston assembly is generally indicated at 20. Referring initially to FIGS. 1-3, the piston assembly 20 includes a piston head generally shown at 22, and having a top 24 that extends radially from a first axis A to a circular periphery 26. A combustion bowl 28 extends into the top 24 and is disposed about the first axis A radially inwardly from the circular periphery 26. A ring belt 30 depends downwardly from the circular periphery 26 in a cylindrical shape. A plurality of ring grooves 32 extend into the ring belt 30 for receiving a plurality of piston rings. Although the piston head 22 and ring belt 30 are shown and described as being circular and cylindrical, respectively, it should be understood that the radius about which the top 24 extends could vary, resulting in, for example, an oval shape.

A first pin boss 34 depends downwardly from the top 24 of the piston head 22 and defines a first pin bore 36. A second pin boss 38 depends downwardly from the top 24 and defines a second pin bore 40. The first and second pin bosses 34, 38 are spaced radially inwardly of the ring belt 30 and spaced from one another, and the first pin bore 36 is axially aligned with the second pin bore 40. The first pin boss 34 extends in the direction of the first pin bore 36 between a first inner edge 42 and a first outer edge 44, and the second pin boss 38 extends in the direction of the second pin bore 40 between a second inner edge 46 and a second outer edge 48.

A connecting rod 50 extends between a piston end 52 and a crank end (not shown). The piston end 52 of the connecting rod 50 includes a fork generally shown at 56. The fork 56 includes a first connecting boss 58 defining a first connecting bore 60 and a second connecting boss 62 spaced from the first connecting boss 58 defining a second connecting bore 64. The first and second connecting bores 60, 64 are axially aligned with each other.

A piston skirt is generally shown at 66, and includes a skirt wall 68 extending along a curve about the first axis A for axial alignment with the ring belt 30. According to the first and second exemplary embodiments, the skirt wall 68 extends cylindrically about the first axis A. The skirt wall 68 extends axially along the first axis A between an upper edge 70 and a lower edge 72 to engage a cylinder wall of an engine cylinder. The piston skirt 66 includes a bridge 74 extending diametrically through the first axis A. A skirt bore 76 is defined in the bridge 74, for axial alignment with the connecting bores 60, 64 and pin bores 36, 410. The bridge 74 provides rigidity to support the piston skirt 66 against side loads exerted on the skirt wall 68 as it engages the cylinder wall during piston stroke. In addition, the support provided by the bridge 74 permits the skirt wall 68 to be fabricated from a thinner material, such as sheet metal.

A wrist pin 78 is provided for interconnecting the piston head 22 to the connecting rod 50 and piston skirt 66 in articulated fashion. The wrist pin 78 has a cylindrical shape defining a wrist pin diameter D. The skirt wall 68 defines a passage 80 axially aligned with the skirt bore 76 for permitting passage 80 of the wrist pin 78 there through. Although a single passage 80 is shown, it should be appreciated that two passages 80 could be formed on opposite sides of the skirt wall 68 for ease of manufacturing or installation. Although the skirt wall 68 and passage 80 are shown in the drawings as a cylinder having a hole therein, one alternative includes a skirt wall 68 being discontinuous and extending along a curve disposed about the first axis A from opposite ends of the bridge 74, with empty space between portions of the skirt wall 68 acting as the passage 80. The skirt wall 68 defines a first axial height H in the direction of the first axis A of between 2-20% greater than the wrist pin diameter ED. For example, if the wrist pin diameter D is 500 millimeters, the first axial height H of the skirt wall 68 would be between 510 millimeters and 600 millimeters.

The bridge 74 is disposed between the first and second connecting bosses 58, 62, which are disposed between the first and second pin bosses 34, 38. The first and second pin bores 36, 40 are axially aligned with the first and second connecting bores 60, 64 and with the skirt bore 76 on a second axis B. The wrist pin 78 extends within the first and second pin bores 36, 40 between the first outer edge 44 of the first pin boss 34 and the second outer edge 48 of the second pin boss 38. The wrist pin 78 also extends through the first and second connecting bores 60, 64 and through the skirt bore 76 along the second axis B to interconnect the piston head 22 and the connecting rod 50 and the piston skirt 66 in articulated fashion.

According to the first exemplary embodiment, the first pin bore 36 extends through the first pin boss 34 from the first inner edge 42 to the first outer edge 44. The second pin bore 40 extend through the second pin boss 38 from the second inner edge 46 to the second outer edge 48. A pair of the circlips 82 surround the wrist pin 78 to engage the first and second pin bosses 34, 38 to limit axial movement of the wrist pin 78.

Figure 4:
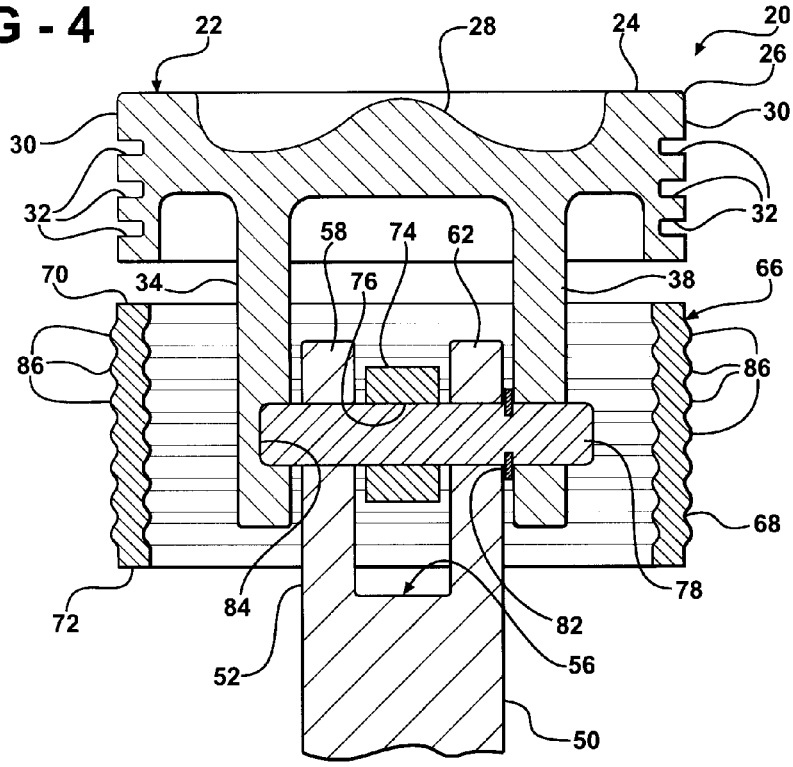
FIG. 4 is a partial cross sectional view of a piston assembly according to a second exemplary embodiment taken along a line similar to line 1-1 of FIG. 2.

According to the second exemplary embodiment, as can be seen in FIG. 4, the first pin bore 36 extends within the first pin boss 34 axially from the first inner edge 42 toward the first outer edge 44 and terminates between the first inner and first outer edges, 42, 44 to define a blind bore 84. In this embodiment, a single circlip 82 surrounds the wrist pin 78 to engage the second pin boss 38 to limit axial movement of the wrist pin 78.

Figure 5:
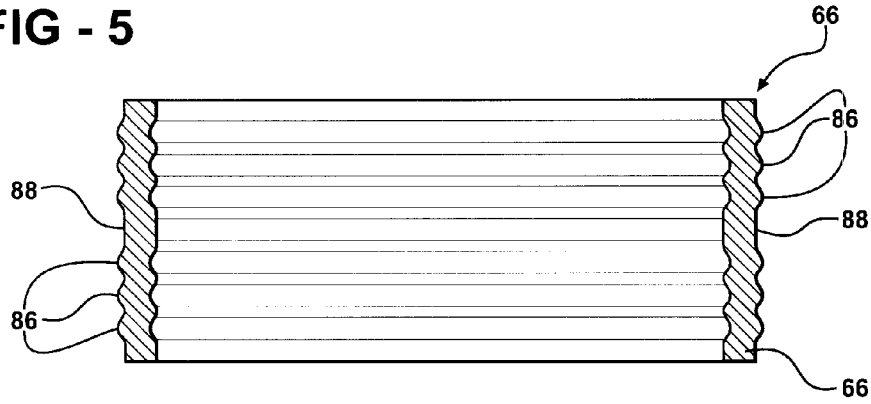
FIG. 5 is a cross sectional view of a piston skirt in isolation according to a third exemplary embodiment.

Referring again to FIGS. 1-3, the skirt wall 68 includes a plurality of corrugations 86 disposed circumferentially about the first axis A and extending axially along the first axis A between the upper and lower edges 70, 72. According to the first exemplary embodiment, the corrugations 86 extend continuously along the first axis A between the upper and lower edges 70, 72. According to the third exemplary embodiment, as shown in FIG. 5, groups of corrugations 86 can be arranged and spaced axially from each other, and separated from each other with straight sections 88. The corrugations 86 provide additional support against the side loads exerted on the skirt wall 68.

Obviously, many modifications and variations of the present invention are possible in light of the above teachings and may be practiced otherwise than as specifically described while within the scope of the appended claims.

What is claimed is:

1. A piston assembly comprising;

a piston head having a top extending radially from a first axis, said piston head including a first pin boss depending from said top and having a first pin bore, said piston head including a second pin boss spaced from said first pin boss and depending from said top and having a second pin bore axially aligned with said first pin bore, a connecting rod having a piston end, said piston end of said connecting rod including a fork having a first connecting boss having a first connecting bore and having a second connecting boss spaced from said first connecting boss and having a second connecting bore axially aligned with said first connecting bore, a piston skirt including a skirt wall extending along a curve disposed about said first axis for engaging a cylinder wall of an engine cylinder, said piston skirt including a bridge extending from said skirt wall through said first axis, said bridge having a skirt bore, a wrist pin, said bridge being disposed between said first and second connecting bosses and said first and second connecting bosses being disposed between said first and second pin bosses with said first and second pin bores axially aligned with said first and second connecting bores and with said skirt bore on a second axis, and said wrist pin extending within said first and second pin bores and said first and second connecting bores and said skirt bore along said second axis to interconnect said piston head and said connecting rod and said piston skirt.

2. A piston assembly as set forth in claim 1 wherein said skirt wall defines a passage axially aligned with said first and second pin bores and with said first and second connecting bores and with said skirt bore for permitting passage of said wrist pin therethrough.

3. A piston assembly as set forth in claim 2 including at least one circlip surrounding said wrist pin to engage one of said first and second pin bosses for limiting axial movement of said wrist pin along said second axis.

4. A piston assembly as set forth in claim 3 wherein said first pin boss extends axially between a first inner edge and a first outer edge and second pin boss extends axially between a second inner edge and a second outer edge and wherein said wrist pin extends between said first outer edge of said first pin boss and said second outer edge of said second pin boss.

5. A piston assembly as set forth in claim 4 wherein said first pin bore extends through said first pin boss between said first inner edge and said first outer edge and second pin bore extend through said second pin boss between said second inner edge and said second outer edge and wherein a pair of said circlips surround said wrist pin to engage said first and second pin bosses.

6. A piston assembly as set forth in claim 3 wherein said first pin bore extends within said first pin boss axially from said first inner edge toward said first outer edge and terminates between said first inner and first outer edges to define a blind bore and wherein said circlip engages said second pin boss.

7. A piston assembly as set forth in claim 2 wherein said skirt wall defines a first axial height in the direction of said first axis and wherein said wrist pin has a cylindrical shape having a pin diameter and wherein said first axial height of said skirt wall is at least 2% greater than said pin diameter.

8. A piston assembly as set forth in claim 7 wherein said first axial height of said skirt wall is between 2-20% greater than said pin diameter.

9. A piston assembly as set forth in claim 2 wherein said skirt wall extends cylindrically about said first axis having a cylindrical shape for axial alignment with said piston head.

10. A piston assembly as set forth in claim 9 wherein said skirt wall includes a plurality of corrugations disposed circumferentially about said first axis and extending axially along said first axis between said upper and lower edges.

11. A piston assembly as set forth in claim 10 including groups of said corrugations spaced axially from each other and separated by at least one straight section.

12. A piston assembly as set forth in claim 10 wherein said corrugations extend axially continuously along said first axis between said upper and lower edges.

13. A piston assembly as set forth in claim 9 wherein said piston head has a top extending radially from a first axis to a circular periphery and defines a combustion bowl extending into said top and disposed about said first axis and radially inwardly from said circular periphery and wherein said piston head includes a ring belt depending downwardly from said circular periphery in a cylindrical shape and having a plurality of ring grooves extending into said ring belt for receiving a plurality of piston rings and being axially aligned with said skirt wall.

14. A piston assembly comprising;

a piston head having a top extending radially from a first axis to a circular periphery and having a combustion bowl extending into said top and disposed about said first axis and radially inwardly from said circular periphery, said piston head including a ring belt depending downwardly from said circular periphery in a cylindrical shape and having a plurality of ring grooves extending into said ring belt for receiving a plurality of piston rings, said piston head including a first pin boss depending downwardly from said top and spaced radially inwardly of said ring belt and having a first pin bore, said piston head including a second pin boss spaced from said first pin boss and depending downwardly from said top and spaced radially inwardly of said ring belt and having a second pin bore axially aligned with said first pin bore, said first pin boss extending in the direction of said first pin bore between a first inner edge and a first outer edge, said second pin boss extending in the direction of said second pin bore between a second inner edge and a second outer edge, a connecting rod extending between a piston end and a crank end, said piston end of said connecting rod including a fork having a first connecting boss having a first connecting bore and having a second connecting boss spaced from said first connecting boss having a second connecting bore axially aligned with said first connecting bore, a piston skirt including a skirt wall extending cylindrically about said first axis for axial alignment with said ring belt and extending axially along said first axis between an upper edge and a lower edge for engaging a cylinder wall of an engine cylinder, said piston skirt including a bridge extending diametrically through said first axis, said bridge having a skirt bore, a wrist pin having a cylindrical shape having a wrist pin diameter, said skirt wall having a passage axially aligned with said skirt bore for permitting passage of said wrist pin there through, said skirt wall having a first axial height in the direction of said first axis of between 2-20% of said wrist pin diameter, at least one circlip, said bridge being disposed between said first and second connecting bosses and said first and second connecting bosses being disposed between said first and second pin bosses with said first and second pin bores axially aligned with said first and second connecting bores and with said skirt bore on a second axis, said wrist pin extending within said first and second pin bores between said first outer edge of said first pin boss and said second outer edge of said second pin boss and through said first and second connecting bores and through said skirt bore along said second axis to interconnect said piston head and said connecting rod and said piston skirt, said circlip surrounding said wrist pin to engage one of said first and second pin bosses for limiting axial movement of said wrist pin along said second axis, and said skirt wall including a plurality of corrugations disposed circumferentially about said first axis and extending axially along said first axis between said upper and lower edges.

15. A piston assembly as set forth in claim 14 wherein said first pin bore extends through said first pin boss between said first inner edge and said first outer edge and second pin bore extends through said second pin boss between said second inner edge and said second outer edge and wherein a pair of said circlips surround said wrist pin to engage said first and second pin bosses.

16. A piston assembly as set forth in claim 14 wherein said first pin bore extends within said first pin boss axially from said first inner edge toward said first outer edge and terminates between said first inner and first outer edges to define a blind bore and wherein said circlip engages said second pin boss.

* * * * *